United States Patent [19]

Henkin et al.

[11] Patent Number: 4,731,887

[45] Date of Patent: Mar. 22, 1988

[54] WATER ENTRAINMENT HYDROTHERAPY JET ASSEMBLY

[76] Inventors: Melvyn L. Henkin, 5011 Donna Ave., Tarzana, Calif. 91356; Jordan M. Laby, 3038 Bayshore, Ventura, Calif. 93001

[21] Appl. No.: 64,138

[22] Filed: Jun. 19, 1987

[51] Int. Cl.[4] ..... A61H 33/02; E03C 1/02

[52] U.S. Cl. ..... 4/541; 4/542; 4/544; 4/492; 4/496; 128/66

[58] Field of Search ..... 4/496, 492, 542, 541, 4/544, 497, 491, 504, 559, 490; 128/66; 239/428, 428.5

[56] References Cited

U.S. PATENT DOCUMENTS

| | | | |
|---|---|---|---|
| 3,287,741 | 11/1966 | Nash | 4/544 |
| 3,345,982 | 10/1967 | Guiler | 4/559 X |
| 3,605,131 | 9/1971 | Brazel et al. | 4/491 |
| 3,614,952 | 10/1971 | Agnellino | 4/544 X |
| 3,977,027 | 8/1976 | Speck | 128/66 X |
| 4,402,094 | 9/1983 | Sanders | 4/504 |
| 4,416,030 | 11/1983 | Reynoso | 4/496 |
| 4,422,191 | 12/1983 | Jaworski | 4/496 |
| 4,502,168 | 3/1985 | Jaworski | 4/496 |
| 4,508,665 | 4/1985 | Spinnett | 4/542 X |
| 4,525,881 | 7/1985 | Higginbotham | 4/492 X |
| 4,541,780 | 9/1985 | Moreland | 4/541 X |
| 4,542,854 | 9/1985 | Mathis | 4/542 X |
| 4,671,463 | 6/1987 | Moreland et al. | 4/542 X |

*Primary Examiner*—Henry K. Artis

*Attorney, Agent, or Firm*—Freilich, Hornbaker, Rosen & Fernandez

[57] ABSTRACT

A hydrotherapy jet assembly and/or installation configured to discharge a high intensity stream into a water tub without requiring air entrainment. Passageway means are provided for drawing water from the tub into the mixing chamber of a jet assembly for entrainment by a water jet. The stream discharged from the jet assembly into the tub is comprised of (1) water supplied under pressure into the mixing chamber by a water jet nozzle and (2) water drawn from the tub for entrainment by the water jet. The effect of tub water entrainment is to produce a high intensity stream for impacting against a user's body without significantly lowering the temperature of the water pool in the tub.

24 Claims, 9 Drawing Figures

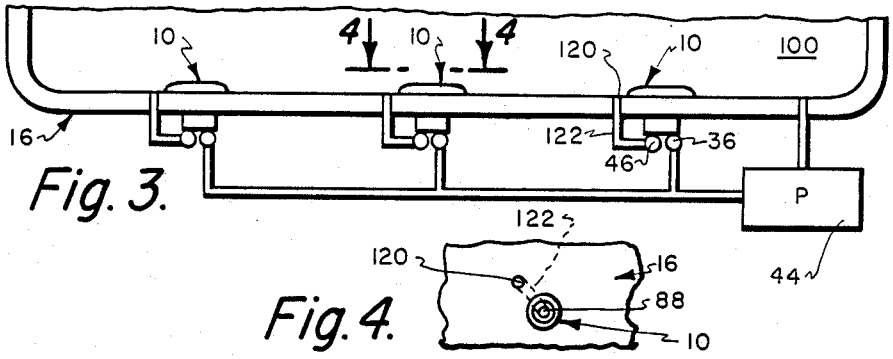
Fig. 3.
Fig. 4.
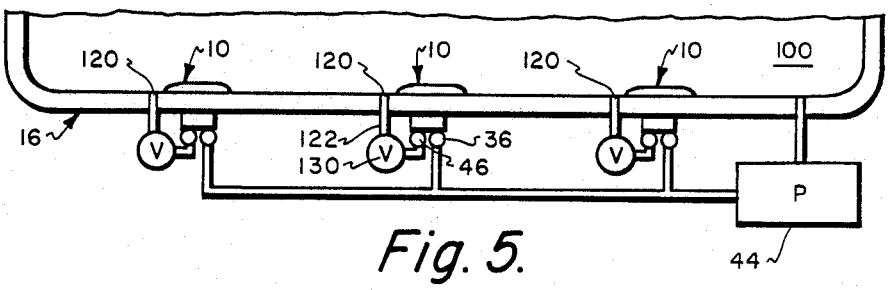
Fig. 5.
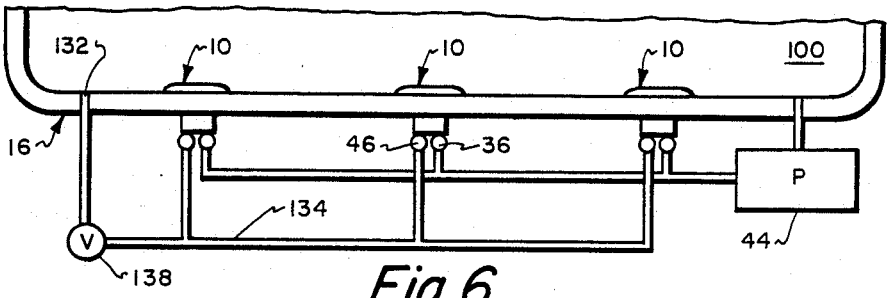
Fig. 6.
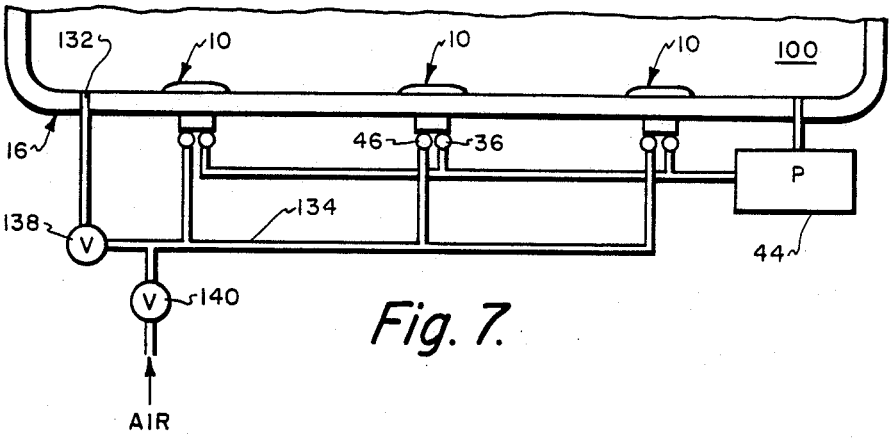
Fig. 7.

WATER ENTRAINMENT HYDROTHERAPY JET ASSEMBLY

BACKGROUND OF THE INVENTION

This invention relates generally to hydrotherapy and more particularly to improvements in hydrotherapy jet installations for use in water tubs, typically referred to as spas, hot tubs, and jetted bathtubs.

Hydrotherapy jet assemblies of various configurations are well known in the art and are readily commercially available. Such assemblies are typically comprised of a housing adapted for mounting behind an opening in a tub peripheral wall. A nozzle mounted in the housing receives water under pressure from a water supply pipe and discharges a water jet through a mixing chamber, creating a low pressure therein, and drawing ambient air into the chamber, via a suction opening, from an air supply pipe. The water jet entrains the air and the resulting water/air stream then exits through a tubular flow director having a discharge orifice into the tub, below the surface of a water pool therein.

Exemplary prior art jet assemblies are disclosed in U.S. Pats. Nos. 3,890,655, 3,890,656, and 3,949,449. These particular patents were the subject of litigation in *Mathis v. Hydro Air Industries, Inc.* 1 U.S.P.Q. 2nd 1513 (D.C. C.D. CA, 1986). The case, as reported, includes a listing of additional prior art at pages 1524, 25.

The water/air stream preferably exits from the discharge orifice at a high velocity for the dual purposes of creating turbulence in the water pool and impacting against a user's body. Typically, the tubular flow director, or "eyeball", can be manually adjusted by the user to enable him to selectively direct the discharged stream. Then, by moving his body relative to the stream, the user is able to massage various body muscles.

Parenthetically, it is pointed out that whereas typical jet assemblies enable the user to direct the discharge stream in a selected, but stationary direction, applicants' copending applications Nos. 843,151 filed Mar. 24, 1986, 902,179 filed Aug. 29, 1986, 796,987 filed Nov. 12, 1985, and 038,780 filed Apr. 15, 1987, disclose jet assemblies for discharging a stream while concurrently translating the stream along a path oriented substantially perpendicular to the stream direction.

Hydrotherapy jet assemblies are typically used in situations where it is desired to maintain the water pool at an elevated temperature for the comfort of the user. (In spa and hot tub situations, the water is typically circulated through a heater to maintain the desired water temperature. In bathtub situations, the tub is typically first filled with hot tap water and then additional hot tap water is added as required). It is commonly recognized, however, that the ambient air entrained by the water jet acts to lower the water temperature thus requiring more heater intervention or more hot water replacement. Although it might at first seem that this problem could be readily avoided by reducing the amount of air entrained by the water jet, this solution is not acceptable because the intensity of the discharge stream typically diminishes considerably as the amount of entrained air decreases.

This reduction in discharge stream intensity (i.e. momentum) occurs because the area of the nozzle outlet is typically much smaller than the area of the passage through the flow director to the discharge orifice. The discharge orifice is typically made longer to define a larger impact spot against the user's body. When sufficient air is entrained by the water jet, the air tends to fill the difference in area between the discharge orifice and the nozzle outlet to thus maintain the velocity (and momentum) of the water jet. When the amount of air is reduced, the velocity of the water slows thus diminishing the intensity of the stream exiting from the discharge orifice.

SUMMARY OF THE INVENTION

The present invention is directed to an improved hydrotherapy jet installation configured to discharge a high intensity stream without requiring air entrainment.

In accordance with the invention, passageway means are provided for drawing water from the tub into the mixing chamber of a jet assembly for entrainment by the water jet. The stream discharged from the jet assembly into the tub is thus comprised of (1) water supplied under pressure into the mixing chamber by the water jet nozzle and (2) water drawn (aspirated) from the tub for entrainment by the water jet. The tub water entrained by the water jet increases the mass of the stream discharged from the discharge orifice, as compared to the mass of the water jet alone. Thus, the effect of tub water entrainment is to maintain the momentum of the water jet to produce an apparently higher intensity stream for impacting against a user's bode, as compared to a stream without air entrainment, without significantly lowering the temperature of the water pool.

In accordance with one embodiment of the invention which can utilize a conventional jet assembly structure, tub water, rather than air, is supplied to the mixing chamber suction inlet. Preferably valve means are also provided for enabling user to vary the amount of tub water entrained by the jet to thus adjust the discharge stream intensity.

In accordance with a preferred embodiment of the invention, a specially configured jet assembly structure is used which is similar to prior art structure but which differs therefrom in that a passageway is integrated into the assembly for passing tub water rearwardly around the flow director into the mixing chamber for entrainment by the water jet. More particularly, a conventional jet assembly typically includes a housing having an internally threaded cavity with a nozzle mounted at one end for discharging a water jet axially into the cavity. A wall fitting carrying a tubular flow director or "eyeball" is threaded into the cavity so that the flow director inlet orifice is substantially aligned with the nozzle. The housing and fitting each have radially extending flanges for mounting the assembly in an opening in the peripheral wall of a water tub by sandwiching the wall between the flanges. A suction inlet conventionally opens into a mixing chamber formed in the housing cavity so that suction created by the water jet can draw in ambient air for entrainment by the water jet. Whereas in such conventional jet assemblies, the only fluid inlets to the mixing chamber are from the nozzle outlet and an air pipe, in accordance with the preferred embodiment of the present invention, an additional inlet comprises a water passageway formed in the wall fitting exteriorly of the flow director.

As in a conventional jet assembly, the flow director comprises a tubular member having an interior wall surface defining a short flow path extending from the inlet orifice to a discharge orifice and an exterior wall surface having a substantially spherically shaped portion. The flow director is held in an internal cavity of the wall fitting by an annulus threaded into the cavity and bearing axially against a coil spring which is held against a wall fitting flange extending radially inward in the cavity. Whereas the annulus conventionally seals against the flow director exterior wall surface, in the preferred embodiment of the present invention, the annulus is configured with openings to define the aforementioned passageway for permitting water flow around the flow director exterior wall surface into the mixing chamber.

In accordance with a further feature of the preferred embodiment, a second annulus is threaded into the wall fitting internal cavity and cooperates with the flow director exterior wall surface to adjust the effective size of the passageway and thus the amount of tub water which can be drawn into the mixing chamber for entrainment by the water jet.

In accordance with the invention, the passageway is intended to be of sufficient size when fully open to permit a relatively large tub water flow into the mixing chamber for entrainment by the water jet. In a preferred embodiment, the passageway area, when fully open, should approximate the difference between the nozzle outlet area and the flow director discharge orifice area. Smaller passageways can be used but the enhanced discharge stream intensity achieved in accordance with the invention diminishes as the passageway area is reduced. Accordingly, it is proposed that the passageway area be no less than 20% of the difference between the nozzle outlet area and the discharge orifice area.

DESCRIPTION OF THE FIGURES

FIG. 3 is a schematic plan view of a hydrotherapy installation in accordance with the invention which can utilize the prior art jet assembly of FIG. 1;

FIG. 4 is a schematic plan view of a jet assembly of FIG. 3 taken substantially along the plane 4—4 of FIG. 3;

FIG. 5 is a schematic plan view of an alternative hydrotherapy installation in accordance with the invention;

FIG. 6 is a schematic plan view of a further alternative installation in accordance with the invention;

FIG. 7 is a schematic plan view of a still further alternative installation in accordance with the invention;

DETAILED DESCRIPTION

Figure 1:
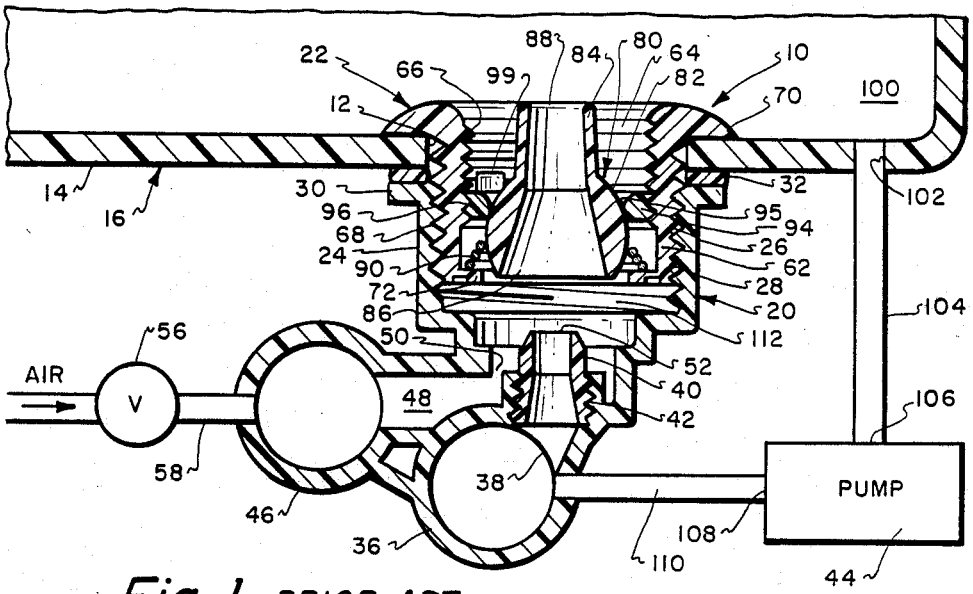
Fig. 1. PRIOR ART
FIG. 1 is a sectional view of a prior art hydrotherapy jet assembly mounted in an opening of the peripheral wall of a water tub, and schematically showing conventional plumbing for supplying ambient air and pressurized water to the jet assembly.
Figure 2:
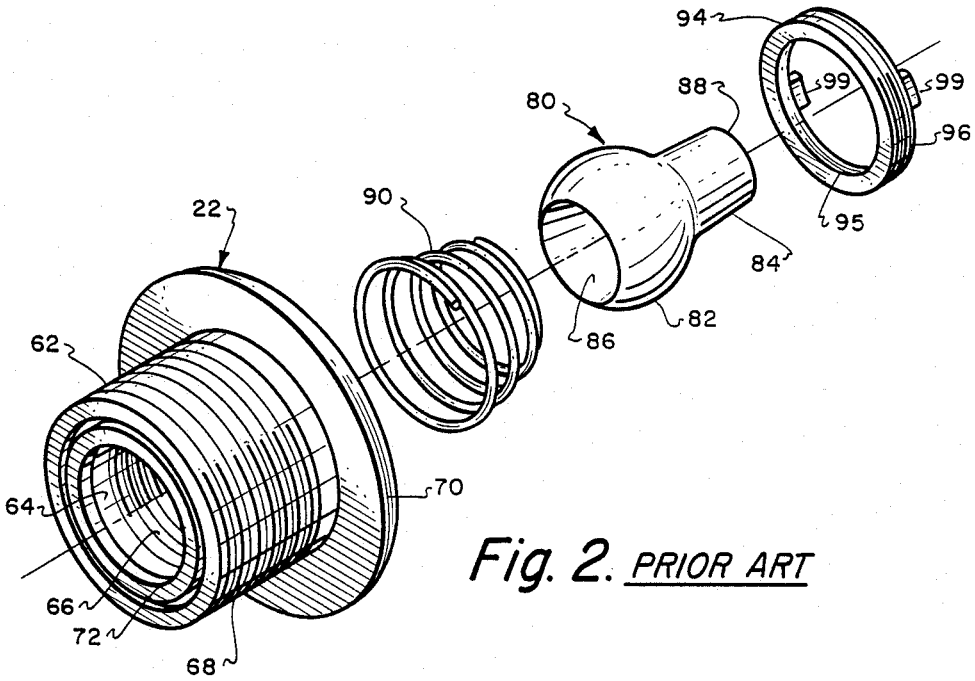
Fig. 2. PRIOR ART
FIG. 2 is an exploded isometric view showing the wall fitting and isolated elements of the jet assembly of FIG. 1.

Attention is initially directed to FIGS. 1 and 2 which illustrate a typical prior art hydrotherapy jet assembly 10 mounted in an opening 12 of the peripheral wall 14 of a water tub 16, such as a spa, hot tub, jetted bath tub, etc. Briefly, the jet assembly 10 is comprised of a housing 20 which is mounted adjacent to the rear face of the peripheral wall 14 and a wall fitting 22 which is mounted adjacent the front face of the peripheral wall 14, nesting within a cavity of the housing 20.

More particularly, the housing 20 comprises a substantially cylindrically shaped body 24 having an internal cylindrical cavity 26 defined by a threaded interior wall surface 28. At one end, the cylindrical body 24 is provided with a radially outwardly extending flange 30 intended to bear against the rear face of peripheral wall 14 with a suitable gasket material 32 sandwiched therebetween.

The housing 20 is shaped to define a cylindrical water pipe section 36 which opens at 38 into a nozzle member 40 threaded into a boss 42. The nozzle 40 is oriented substantially along the axis of the cylindrical cavity 26. Pressurized water is supplied to the pipe section 36, as by an electrically driven pump 44 to cause the nozzle to discharge a water jet axially into the cavity 26. The housing 20 further defines an air pipe section 46 which opens via path 48 including suction inlet 50, into the cavity 26 proximate to the nozzlw outlet 52. In typical installations, ambient air is supplied via valve 56 and pipe 58 to the interior of pipe section 46.

The jet assembly 10 further includes the aforementioned wall fitting 22 which comprises a substantially cylindrical member 62 including an open central cavity 64 defined by a threaded interior wall surface 66. The wall fitting 22 additionally has an exteriorly threaded wall surface 68 which is threaded into the interior wall surface 26 of housing 20. The wall fitting 22 also includes a radially outwardly extending flange 70 at one end and a radially inwardly extending flange 72 at its other end.

The wall fitting 32 additionally includes an adjustable flow director or "eyeball" comprising a tubular member 80 having an enlarged spherical portion 82 and a substantially cylindrical portion 84. The tubular member 80 defines a central flow path extending from an inlet orifice 86, through a throat region, to a discharge orifice 88. The tubular member 80 extends through the center of a tapered coil spring 90. The springs larger diameter coils are intended to rest on the inwardly extending flange 72 of wall fitting 22 with the smaller diameter coils engaging the outer spherical surface of the spherical portion 82.

The wall fitting 22 further includes an annulus, i.e. open ring, 94 which has a threaded outer surface 96 threaded into the interior surface 66 of cylindrical member 62. The inner diameter of the annulus 94 is provided with a lip 95 dimensioned to engage the outer spherical surface of spherical portion 82 to seal thereagainst. The spherical portion 82 is urged upwardly (as depicted in FIG. 1) against the annulus lip 95 by spring 90. A user is able to adjust the orientation of the tubular member 80 by pressing the member 80 inwardly (i.e. toward the nozzle 40) to slightly compress the spring 90 thus enabling the spherical portion 82 to rotate relative to the annulus lip 95. When released, the spring 90 again urges the spherical portion 82 into sealing engagement with the annulus lip. Note that the annulus 94 is provided with a pair of tabs 99 to facilitate the manual threading of the annulus.

In the conventional use of the hydrotherapy jet assembly 10 of FIG. 1, the electrically driven pump 44 draws water into its suction side from a water pool 100 in the tub 16 via an opening 102 in peripheral wall 14 and return line 104. The pump in turn discharges that water from its discharge side 108 to the water pipe section 36 via pipe 110, which typically comprises a manifold coupled to a plurality of jet assemblies. The pressurized water supplied by the pump 44 causes the nozzle 40 to discharge a jet from outlet 52 into the inlet orifice 86 of tubular member 80. As is well known, when the water jet emerges from the outlet 52, it creates a low pressure in the mixing chamber 112 just forward of the outlet 52, and extending into the throat section of the tubular member 80. This lowered pressure produces a suction effect in the mixing chamber functioning to draw ambient air from pipe section 46 into the chamber via suction inlet 50. This air is entrained by the water jet to produce a water/air stream which then flows through the tubular member 80 and discharges through the orifice 88 beneath the surface of water pool 100.

The foregoing describes the structure of a typical prior art jet assembly and a conventional plumbing installation using such an assembly. Although such jet assemblies find wide use in hydrotherapy applications for creating water turbulence and massaging user's bodies, it is commonly recognized that the ambient air supplied through pipe 58 for entrainment by the water jet acts to lower the temperature of the water pool 100. Generally, the user desires to maintain the temperature of the water pool 100 at an elevated level and this is accomplished in a typical spa situation by, for example, providing a heater (either electrically or gas fired) in series with the pump 44 or in a bathtub situation by supplying additional hot tap water to the water pool 100. The heat loss problem could of course be aleviated by shutting off the ambient air supply by use of valve 56. However, this is not a satisfactory solution because without the air mass entrained by the water jet, the intensity of the stream discharged from discharge orifice 88 will diminish considerably.

A significant object of the present invention is to provide an improved hydrotherapy jet installation configured to discharge a high intensity stream without requiring air entrainment. Specifically, in accordance with a basic aspect of the present invention, in lieu of entraining ambient air, water from the pool 100 is entrained by the water jet discharged from nozzle 40.

Attention is now directed to FIG. 3 which illustrates a first embodiment of the invention showing how the conventionally structured hydrotherapy jet assemblies 10 of FIG. 1 are utilized to discharge a high intensity stream without significantly reducing the temperature of the water pool. Specifically, as depicted in FIG. 3, an opening 120 is formed in the tub peripheral wall adjacent to the jet assembly 10. Pipe 122 is used to couple the opening 120 to what was previously referred to as the air pipe in Figure 1. In other words, in lieu of opening pipe 46 to ambient air, as is conventional practice and as is depicted in Figure 1, FIG. 2 depicts that the opening 120 and pipe 122 provides a passageway from the water pool 100 to the suction inlet 50 and mixing chamber of the jet assembly 10. Thus, with pressurized water supplied by pump 44 to the water pipe 36, tub water will be drawn through the passageway defined by 122 into the mixing chamber 112 for entrainment by the water jet produced by nozzle 40. In order to assure the availability of sufficient tub water for entrainment by the water jet, it is important that the pipe 122 provide a sufficiently large passageway. Preferably, the cross sectional area A3 of the passageway should be equal to the difference between the area A1 of the nozzle outlet 52 and the area A2 of the discharge orifice 88 of the tubular member 80. In any event, in accordance with the invention, the passageway area A3 should be equal to or greater than 20% of the difference between the discharge orifice area A2 and the nozzle outlet area A1.

FIG. 4 shows a plan view of one of the jet assemblies 10 of FIG. 3 as would be seen by a user sitting in the tub 16. Note that the opening 120 is located vertically above the discharge orifice 88. This placement prevents the discharge of a high intensity stream above the pool water level which could splash out of the tub. That is, a high intensity stream will only be discharged when the pool water level is above the opening 120 so as to allow tub water to be entrained. When the pool water level is below the opening 120, then the intensity of the discharge stream will be insufficient to splash out of the tub.

FIG. 5 illustrates a variation of the system shown in FIG. 3 in which a valve means 130 is incorporated in the pipe 122 for enabling a user to vary the amount of tub water drawn through the passageway 122 into the jet assembly mixing chamber 112. By adjusting the valve 130, the user can vary the intensity of the stream discharged from the discharge orifice 88.

Whereas the embodiment of FIG. 5 depicts a plurality of wall openings 120, each associated with a different jet assembly 10, FIG. 6 depicts a variation in which a single wall opening 132 is provided and connected to a tub water manifold 134 forming the passageway to the pipes 46 of each of the jet assemblies 10. A manually adjustable valve 138 is preferably included in the pipe between opening 132 and manifold 134. Adjustment of the valve 138 varies the stream intensity discharged from all of the jet assemblies. It should, of course, be recognized that the opening 132 and manifold 134 must be large enough in cross-sectional area to distribute tub water to all of the assemblies.

From the foregoing description of FIGS. 3–6, it should now be recognized that applicants have disclosed herein a hydrotherapy system employing conventionally structured jet assemblies which are operated to discharge high intensity streams, comparable to that normally delivered by assemblies entraining ambient air, but with the advantage that the entrained tub water does not reduce the temperature of the pool water as is characteristic of conventional systems.

Although a high intensity stream is discharged by the embodiments of FIGS. 3–6 without lowering the water pool temperature, it is recognized that some users may still desire the appearance of air bubbles in the discharged water stream. In order to accommodate such a preference, FIG. 7 depicts a further variation in which air is introduced via valve 140 into the manifold 134. With the configuration depicted in FIG. 7, by manual manipulation of both valves 138 and 140 (which could be constructed as a single valve mechanism) the user can adjust the ratio of tub water and air drawn via manifold 134 into the chambers of the multiple jet assemblies 10.

Whereas all of the embodiments depicted in Figures 3–7 teach the broad concept of the present invention of providing a passageway for drawing tub water into the mixing chamber of a jet assembly for entrainment by a water jet discharged by a jet assembly nozzle, they all are characterized by a plumbing system which may be considered somewhat more complex than conventional installations. In order to achieve the aforediscussed benefits of entraining tub water while avoiding any additional plumbing complexity, applicants have provided in FIGS. 8 and 9 an improved jet assembly structure in which the passageway for drawing tub water into the assembly mixing chamber is fully defined within the assembly itself. Moreover, the embodiment of FIGS. 8 and 9 can be used to replace jet assemblies 10 in existing installations.

Figure 8:
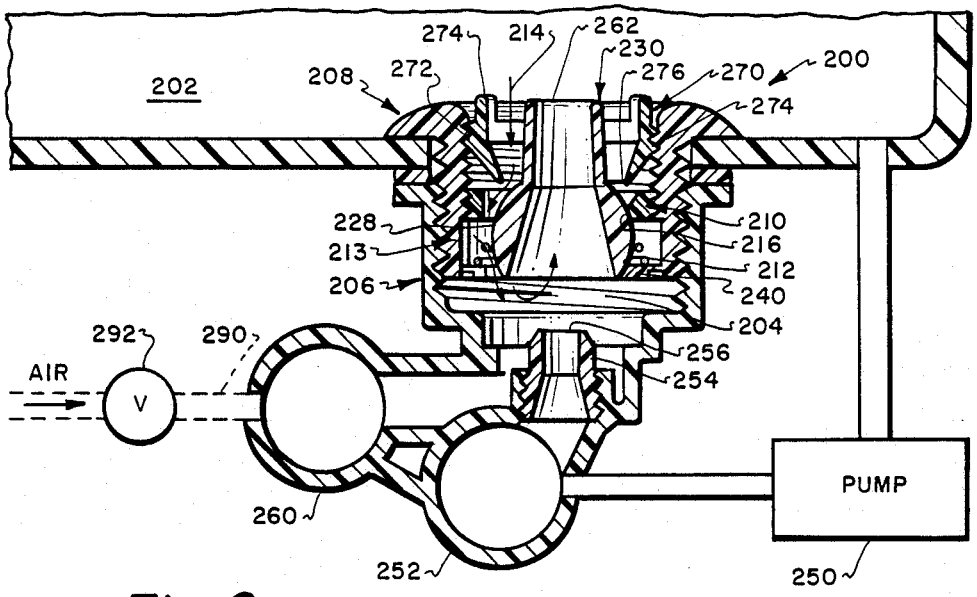
FIG. 8 is a sectional view of a hydrotherapy jet assembly, similar to that depicted in FIG. 1, but modified in accordance with the invention to incorporate a passageway for passing tub water exteriorly of the tubular flow director into the mixing chamber of the assembly.

Attention is now directed to FIG. 8 which shows a jet assembly 200, similar to the jet assembly 10 of FIG. 1, but modified to provide for an interior passageway from the water pool 202 to the mixing chamber 204. The housing 206 of the assembly 200 can be identical to the housing 20 depicted in FIG. 1. The wall fitting 208 differs from the wall fitting 22 of FIG. 1 in that the first annulus 210 and radially inward extending flange 212 on the cylindrical member 213 are configured to define a passageway, represented by the flow arrows 214 in FIG. 8, for passing water from the pool 202 to the chamber 204.

Figure 9:
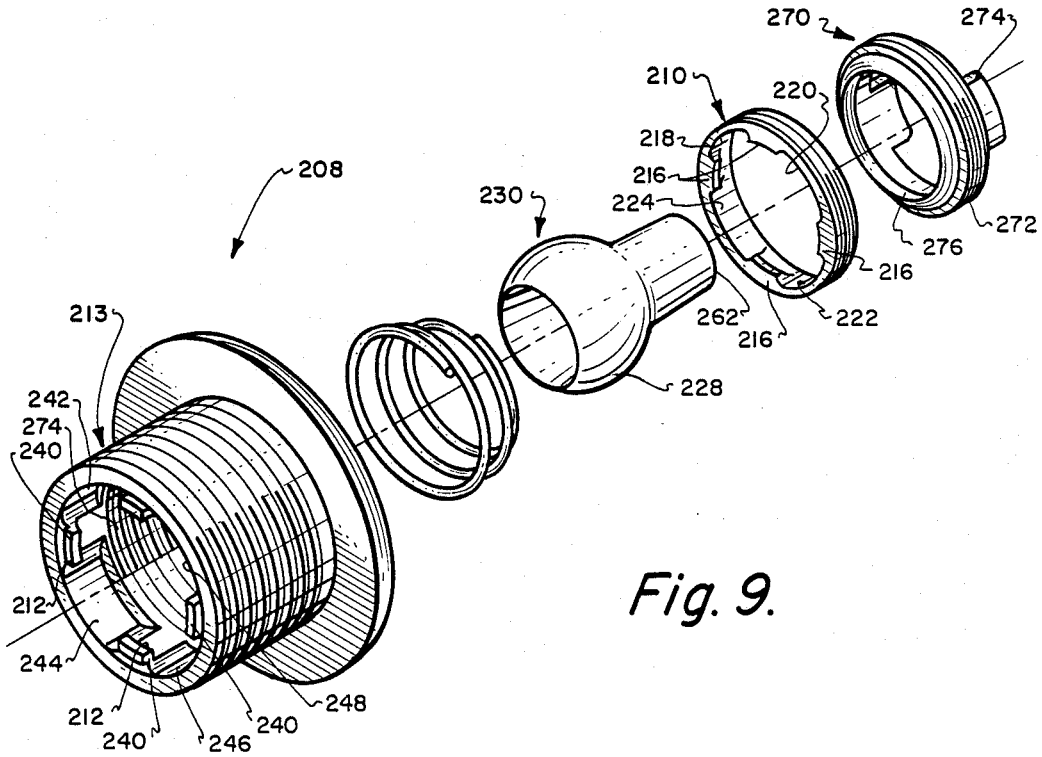
FIG. 9 is an exploded isometric view depicting the wall fitting and related elements of FIG. 8.

More particularly, note in FIG. 9 that the inwardly extending flange 216 of annular 210 is actually comprised of separate fingers spaced by openings 218, 220, 222, and 224. The fingers of flange 216 engage the outer spherical surface 228 of tubular member 230. Similarly, in lieu of providing a continuous inwardly extending flange on the cylindrical member as was depicted in FIG. 1, the flange 212 of Figures 8 and 9 is formed of spaced radially inwardly projecting fingers 240 separated by opening 242, 244, 246, and 248.

With the annulus 210 and the cylindrical member 213 configured as depicted in FIGS. 8 and 9, water from the pool 202 can be drawn into the mixing chamber 204 along a passageway represented by arrows 214. That is, as pressurized water is supplied from pump 250 to water pipe 252, nozzle 254 will discharge a water jet into the throat or inlet of tubular member 230. This will create a suction within the mixing chamber 204 defined proximate to the outlet 256 of nozzle 254. On the assumption that pipe 260 is closed, the suction created by the water jet will suck water from the pool 202 past the annulus 210 and the flange 240 into the chamber 204 for entrainment by the jet for discharge through the tubular member 230.

In order to permit the user to adjust the intensity of the stream discharged from the discharge orifice 262 of tubular member 230, a second annulus 270 is provided. The second annulus 270 includes a threaded exterior surface 272 which threads into the threaded surface 274 of cylindrical member 213. The annulus 270 includes a continuous radially inwardly projecting lip 276 which, by threading the annulus 270 down toward the annulus 210 can restrict the tub water flow passageway 214 to control the amount of water drawn from the pool 202 into the mixing chamber 204. When the annulus 270 is threaded downward sufficiently, its inwardly projecting lip 276 will seal against the spherical surface 228 of the tubular member 230 to close off the passageway 214 entirely.

As aforenoted, it has thus far been assumed that pipe section 260 has been closed so that the suction created within chamber 204 acts to pull water from the pool 202 exteriorly of the tubular member 230 into the chamber 204. Alternatively, pipe section 260 can be coupled via pipe 290 and valve 292 to an air supply, such as an ambient air opening. By adjusting the valve 292 and the position of annulus 270, a user can vary the ratio of air and tub water drawn into the chamber 204 by the water jet discharged from nozzle 254. This configuration is thus analogous to that previously discussed in connection with FIG. 7. The annulus 270 preferably has a pair of tabs 274 axially extending therefrom to faciliate manual adjustment of the annulus 270 for varying the intensity of the stream discarged from orifice 262 of tubular member 230.

As was previously discussed, it is preferable that the jet assembly 200 be dimensionally configured so that the passageway 214 permits a sufficient amount of water to be drawn into the chamber 204. More specifically, with the annulus 270 in a position such that the passageway 214 is fully open, it is preferable that the effective area A3 of the passageway 214 is equal to or greater than 20% of the difference between the area A2 of the discharge orifice 262 and the area A1 of the nozzle outlet 256.

From the foregoing, it should be appreciated that a hydrotherapy system has been disclosed herein in which conventionally structured hydrotherapy jet assemblies are utilized to entrain tub water, rather than air, to discharge high intensity streams without lowering the temperature of the water pool. Specifically, a preferred embodiment of the invention has been disclosed in FIGS. 8 and 9 in which the passageway 214 for drawing tub water into the chamber 204 for entrainment by the water jet discharged by the nozzle 254 is interior to the housing 206 and wall fitting 208 and exterior of the tubular member 230.

We claim:

1. A hydrotherapy jet assembly suitable for mounting in an opening of a water tub peripheral wall for discharging a water stream into said tub for impacting against a user's body, said assembly including:

housing means defining a mixing chamber and including means for discharging a water jet along a defined axis into said chamber for creating a suction therein;

tubular flow director means having an inlet orifice and a discharge orifice;

means mounting said flow director means with said inlet orifice open to said mixing chamber and substantially aligned with said water jet axis whereby water supplied by said jet will flow through said flow director means to said discharge orifice; and passageway means exteriorly of said flow director means for passing water into said chamber, drawn by said suction, from said tub for entrainment by said water jet.

2. The assembly of claim 1 including valve means for opening and closing said passageway means.

3. The assembly of claim 1 including adjustable valve means for varying the amount of water passed by said passageway means for entrainment by said water jet.

4. The assembly of claim 1 further including means for supplying air to said mixing chamber for entrainment by said water jet.

5. The assembly of claim 1 wherein said means for discharging a water jet defines an outlet of area A1 and said discharge orifice has an area A2; and wherein said passageway means defines an area A3, where $A3 \geqq 20\%(A2-A1)$.

6. A hydrotherapy jet assembly comprising:

a housing defining a substantially cylindrical interior cavity having an inlet end and an outlet end;

nozzle means mounted in said cavity proximate to said inlet end for discharging a water jet substantially along the axis of said cavity toward said outlet end;

a tubular member defining an interior flow path having an inlet orifice and a discharge orifice; and means mounting said tubular member in said cavity proximate to said outlet end with said inlet orifice substantially aligned with said cavity axis, said mounting means including means defining a passageway, exteriorly of said tubular member, for passing water into said cavity.

7. The assembly of claim 6 wherein said housing includes a threaded interior wall surface defining said interior cavity; and further including a tubular fitting having an exterior wall surface threadedly engaged with said housing interior wall surface.

8. The assembly of claim 7 wherein said housing includes a radially outwardly extending flange formed proximate to said housing outlet end; and wherein said fitting includes a radially outwardly extending flange spaced from said housing flange whereby said assembly can be mounted in a peripheral wall opening by sandwiching said peripheral wall between said housing flange and said fitting flange.

9. The assembly of claim 7 wherein said tubular fitting includes a radially inwardly extending flange; and wherein said tubular member comprises a wall having an interior wall surface defining said interior flow path and an exterior wall surface having a substantially spherically shaped portion.

10. The assembly of claim 9 wherein said tubular fitting has a threaded interior wall surface; and further including first annulus means threadedly engaged with said fitting interior wall surface for engaging said tubular member;

said first annulus means including openings therein defining said passageway for passing water exteriorly of said tubular member into said cavity.

11. The assembly of claim 10 including adjustable second annulus means threadedly engaged with said fitting interior wall surface for cooperating with said first annulus means to vary the water flow through said passageway.

12. The assembly of claim 6 wherein said nozzle means defines an outlet area of A1 and said discharge orifice defines an area of A2; and wherein said passageway has an effective area $A3 \geqq 20\%(A2-A1)$.

13. In a hydrotherapy jet assembly comprised of:

a housing having an internally threaded cylindrical cavity;

a nozzle mounted at one end of said housing cavity for discharging a water jet toward a second end of said housing cavity;

a tubular fitting threaded into said housing cavity, said fitting having an internally threaded cylindrical cavity and a radially inwardly extending flange in said fitting cavity;

a tubular flow director having an inlet end and a discharge end; and an annulus threaded into said fitting cavity engaging the exterior wall surface of said flow director for urging it toward said flange in said fitting cavity;

the improvement comprising:

passageway means formed in said annulus for permitting water to flow exteriorly of said flow director exterior wall surface past said annulus into said housing cavity.

14. The jet assembly of claim 13 wherein said improvement further comprises:

second annulus means threaded into said fitting cavity for varying the water flow past said first recited annulus.

15. In combination:

a tub for containing a water pool, said tub having a peripheral wall including a jet opening and a water return opening formed therein;

a housing mounted in alignment with said jet opening, said housing defining a mixing chamber and including nozzle means for discharging a water jet along a defined axis into said chamber for creating a suction therein;

electrically driven pump means having an inlet side coupled to said water return opening and an outlet side coupled to said nozzle means for drawing tub pool water and supplying pressurized water to said nozzle means;

a suction inlet formed in said housing communicating with said chamber; and passageway means open to said water pool and communicating with said suction inlet for passing water from said pool into said chamber, drawn by said suction, for entrainment by said water jet.

16. The combination of claim 15 further including adjustable valve means for varying the amount of water passed by said passageway means for entrainment by said water jet.

17. The combination of claim 15 further including means for supplying air to said passageway means for entrainment by said water jet; and adjustable valve means for selectively varying the amounts of water and air passed by said passageway means for entrainment by said water jet.

18. The combination of claim 15 further including:

a tubular member defining an interior flow path having an inlet orifice and a discharge orifice;

means mounting said tubular member in said housing with said inlet orifice open to said mixing chamber and substantially aligned with said water jet axis and said discharge orifice open to the interior of said tub whereby water supplied by said jet will flow out said discharge orifice into said water pool.

19. The combination of claim 18 wherein said passageway means extends through said housing exeriorly of said tubular member.

20. The combination of claim 19 wherein said nozzle means defines an outlet of area A1 and said tubular member discharge orifice has an area A2; and wherein said passageway means defines an area A3, where $A3 \geqq 20\%(A2-A1)$.

21. The combination of claim 18 wherein said passageway means includes an inlet orifice in said tub peripheral wall and a pipe coupling said inlet orifice to said suction inlet.

22. The combination of claim 21 wherein said wall inlet orifice is located vertically above said discharge orifice.

23. A method of discharging a high intensity hydrotherapy stream through an opening in the peripheral wall of a water tub, comprising the steps of:

mounting a housing, having an internal chamber, a suction inlet to said chamber, and a discharge orifice from said chamber, behind said wall with said discharge orifice aligned with said opening;

mounting a nozzle in said housing oriented to discharge a water jet through said chamber to said discharge orifice;

supplying water under pressure to said nozzle for discharging a water jet through said chamber for creating suction therein; and providing a passageway for the flow of pool water from said water tub to said chamber via said suction inlet for entraining said pool water in said water jet for discharge through said discharge orifice.

24. A method of operating a hydrotherapy jet assembly to discharge a high intensity stream through an opening in the peripheral wall of a water tub beneath the surface of a water pool contained therein, which assembly includes a nozzle for discharging a water jet into a mixing chamber to create a suction at an inlet to said chamber and an orifice for discharging a stream from said chamber, said method including the steps of:

pumping water from said water pool and supplying it under pressure to said nozzle to produce said water jet; and providing a passageway from said water pool to said suction inlet for drawing water from said pool for entrainment by said water jet.

* * * * *